US006438756B1

(12) United States Patent
Colorado

(10) Patent No.: US 6,438,756 B1
(45) **Date of Patent: *Aug. 27, 2002**

(54) SUSPENDED EXTRICATION HARNESS APPARATUS HAVING INSTALLATION ASSEMBLY

(76) Inventor: Juancarlos Colorado, P.O. Box 2111, Petaluma, CA (US) 94953

( * ) Notice: Subject to any disclaimer, the term of this patent is extended or adjusted under 35 U.S.C. 154(b) by 0 days.

This patent is subject to a terminal disclaimer.

(21) Appl. No.: 09/893,241

(22) Filed: Jun. 26, 2001

Related U.S. Application Data

(63) Continuation-in-part of application No. 09/616,099, filed on Jul. 14, 2000, now Pat. No. 6,308,335, which is a continuation-in-part of application No. 09/352,664, filed on Jul. 8, 1999, now Pat. No. 6,105,169.

(60) Provisional application No. 60/092,328, filed on Jul. 8, 1998.

(51) Int. Cl.[7] ..... A62B 35/00

(52) U.S. Cl. ..... 2/81; 182/6

(58) Field of Search ..... 2/69, 79, 456, 2/69.5, 81, 85, 230, 108, 94, 102, 311–318, 326–328, 338, 227; 182/3–4, 6–7; 119/770, 797, 907; 244/151 R

(56) References Cited

U.S. PATENT DOCUMENTS

| | | | | | |
|---|---|---|---|---|---|
| 5,136,724 | A | * | 8/1992 | Grilliot et al. | 182/3 |
| 5,289,590 | A | * | 3/1994 | Larson | 2/227 |
| 6,105,169 | A | * | 8/2000 | Colorado | 182/6 |
| 6,244,379 | B1 | * | 6/2001 | Larson | 182/6 |
| 6,308,335 | B1 | * | 10/2001 | Colorado | 182/6 |

* cited by examiner

*Primary Examiner*—Gloria M. Hale
*Assistant Examiner*—Tajash Patel
(74) *Attorney, Agent, or Firm*—Douglas E. White

(57) ABSTRACT

A harness strap assembly is adapted to be incorporated into the inner liner of the pants of a firefighter's turnout suit without requiring structural modification thereof. The harness strap assembly, when installed, comprises a pair of webbed strap members. A waist belt and the harness strap assembly are wound forward around the user's waist through waist belt-loops suspended from a suspender assembly; then down through loops suspended at the crotch of the pant liner; thence back around under the user's buttocks; and finally back forward to the fly area of the liner. Adjacent to the fly of the liner, the crotch portions of the strap pass through a pair of metal or fabric carabiner-holding rings that are attached to looped ends of the harness strap members. The carabiner-holding rings, in turn, are interlinked (by means of a strap) with a metal carabiner of conventional design.

18 Claims, 4 Drawing Sheets

SUSPENDED EXTRICATION HARNESS APPARATUS HAVING INSTALLATION ASSEMBLY

CROSS REFERENCE TO RELATED APPLICATIONS

This application claims the benefit of U.S. Provisional Application No. 60/092,328 filed Jul. 8, 1998, is a continuation-in-part of U.S. application Ser. No. 09/352,664 filed Jul. 8, 1999, which latter application has issued as U.S. Pat. No. 6,105,169, and is a continuation-in-part of U.S. application Ser. No. 09/616,099, filed Jul. 14, 2000 now U.S. Pat. No. 6,308,335. The entire disclosures of U.S. application Ser. Nos. 09/352,664 and 09/616,099 are considered to be a part of the disclosure of this application and are hereby incorporated by reference herein.

FEDERALLY SPONSORED RESEARCH OR DEVELOPMENT

Not applicable.

FIELD OF THE INVENTION

This invention relates to firefighters'turnout suits, more particularly, to turnout pants into which may be added a self-adjusting climber's harness.

BACKGROUND OF THE INVENTION

Firefighters may become entrapped in the upper floors of a multistory building with no internal means of escape. Many tragically have become severely burned, or even killed, as a result. On such occasions, it is known to use a rope and an emergency climbing harness to rappel down to the ground, or at least to a lower floor which is not burning or is otherwise safe. However, such equipment is bulky and therefore not always brought by the firefighter into the building. Even when it is available, in an emergency situation it can be difficult and time consuming to put on, because the firefighter may be running low on oxygen, and smoke and the lack of electric light may be obscuring his or her vision.

Prior developments in this field may be generally illustrated by reference to the following information disclosure statement:

U.S. Pat. Documents

| U.S. Pat. No. | Patentee | Issue Date |
|---|---|---|
| 5,136,724 | W. Grilliot et al. | Aug. 11, 1992 |
| 5,036,548 | W. Grilliot et al. | Aug. 6, 1991 |
| 3,973,643 | J. Hutchinson | Aug. 10, 1976 |
| 2,979,153 | E. Hoagland et al. | Apr. 11, 1961 |
| 4,076,101 | L. Himmelrich | Feb. 28, 1978 |
| 1,574,529 | S. Abrahma | Feb. 23, 1926 |
| 4,645,033 | H. Oselsclager | Feb. 24, 1987 |
| 3,176,793 | R. Hlacia | Apr. 6, 1965 |
| 112,552 | J. Conley | Mar. 14, 1871 |
| 416,550 | J. Betten | Dec. 3, 1889 |

U.S. Pat. Nos. 5,036,548 and 5,136,724 teach forms of combined firefighters' turnout out pants and safety harness.

U.S. Pat. No. 3,973,643 teaches a firefighters'safety coat with detachable harness.

U.S. Pat. No. 2,979,153 teaches a safety suit with built-in harness.

There continues to be a need for a new and improved extrication harness apparatus which addresses the problems of construction, effectiveness and ease of use that are attendant in the prior art. In this respect, the present invention substantially fulfills this need.

SUMMARY OF THE INVENTION

In view of the disadvantages inherent in the known art, the general purpose of the present invention, which will be described subsequently in greater detail, is to teach a new and improved extrication harness apparatus which has all of the important advantages of the prior art and few, if any, of the disadvantages.

Firefighters wear a special turnout suit, the turnout pants of which comprise a fireproof outer shell and a separate thermal-barrier liner. The present invention is a harness strap assembly (hereinafter also referred to as the "harness strap"), similar in function to a climbing harness, that may be suspended from the liner of the pants of a turnout suit. The suit liner, which in the prior art typically has no belt-loops, is modified by the addition of a suspender assembly that supports the harness strap assembly. The suspender assembly may incorporate snaps, suspender-type alligator clips, or hook and loop fastener patches for attachment to the waist area of the suit liner without requiring any structural, invasive or other permanent modification of said thermal-barrier liner. The suspender assembly, or "suspender," provides belt-loops through which the harness strap may be threaded. In this way, the harness strap may be suspended from the liner without violating the integrity of the thermal barrier incorporated therein.

It is to be noted in this regard that the suspender belt-loops do not ever bear the weight of the firefighter, but merely are for positioning the harness around the waist, thighs and crotch of the user during normal wearing of the turnout suit—prior to the need for emergency use.

The suspender assembly comprises a matched pair of front waist belt-loop straps and a rear yoke. Each front waist belt-loop strap bears or forms a loop for the harness strap assembly. The rear yoke forms a pair of upper waist belt-loops and a pair of lower buttock/crotch area belt-loops, again for positioning, holding and supporting the harness strap. The suspender assembly contains non-invasive means for attaching itself to the liner of a turnout suit. "Non-invasive" means, in this context, attaching means which does not itself puncture or otherwise violate the integrity of the thermal-barrier liner. Preferably, this means is non-invasive by using mating means already found on the liner, such as snaps or hook and loop fastener material.

The harness strap assembly comprises a pair of harness strap members that are affixed to the rear of a waist belt and are wound forward around the user's waist through the four suspended waist belt-loops; thence down through the crotch and back around under the user's buttocks; then through the suspended crotch belt-loops; and finally back forward to the fly area of the liner where they terminate in two looped ends. Adjacent to the fly, on their way first down through the crotch, the crotch portions of the harness strap pass through a pair of carabiner-holding rings, which rings are not stitched or otherwise affixed to the liner. Instead, the two looped ends of the harness strap hold the two rings. The carabiner-holding rings, in turn, may be interlinked with a metal carabiner of conventional design. Preferably, the carabiner will be suspended from a carabiner strap that passes from one ring to the other.

The waist belt is supplied chiefly to keep the apparatus comfortably in place during normal wear. The belt may perform the secondary function of keeping the turnout pants up without the need for suspenders.

There preferably is a pair of load-bearing safety-grade adjustment buckles on the rear of the waist belt (to which buckles the harness strap members are attached) or there is other means provided for adjusting the overall length of the harness strap assembly relative to the girth of the wearer. This typically only needs to be done once, during the very first fitting thereof. It never has to be done during an emergency, or even during normal firefighting operations. The waist belt thus further serves as the point of attachment for said pair of adjustment buckles, which hold the free ends of the two harness strap members.

To escape out of a window in a burning building, one need only secure a climbing rope to a suitable fixed structure. Next, the rope is wound through the carabiner (or carabiners) in the normal fashion. The firefighter immediately may rappel down to safety.

There is no need to put the harness on during the time of the emergency, because one automatically encases one's waist and legs in the harness when the turnout pants are put on.

Importantly, as noted above, there is also no need to adjust or tighten the harness during the emergency—when the firefighter may have only precious moments to exit the building. The use of a free-moving harness strap assembly threaded loosely through strategically placed loops suspended from the pant liner allows the harness to be self-adjusting. Unlike known emergency harnesses, the present harness apparatus automatically tightens up upon receiving the user's weight, without binding.

The harness adds little weight to the turnout pants, and, during normal wear, the crotch portions of the harness strap hang loose, so as not to be confining or uncomfortable. Therefore, there is great incentive, and little disincentive, for a firefighter to adopt the modified turnout pants of this invention.

FEATURES AND ADVANTAGES

It is therefore an object of the present invention to provide a new and improved extrication harness apparatus which has all, or nearly all, of the advantages of the prior art, while simultaneously overcoming most of the disadvantages normally associated therewith.

It is another object of the present invention to provide a new and improved extrication harness apparatus which may be easily and efficiently manufactured and marketed.

It is a further object of the present invention to provide a new and improved extrication harness apparatus which is of a rugged, durable and reliable construction and which meets or exceeds known safety standards and codes.

An even further object of the present invention is to provide a new and improved extrication harness apparatus which is susceptible of a low cost of manufacture with regard to both materials and labor, and which accordingly is then susceptible of low prices of sale to firefighters and fire departments, thereby making such a extrication harness apparatus economically available to the buying public.

Still another object of the present invention is to provide extrication harness apparatus wherein the same permits an increased ease of assembly and installation relative to the art.

Another feature is a new and improved extrication harness apparatus that is lightweight, easy to use, unobstructive, unobtrusive in appearance and suitable for mass production.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawing wherein.

DRAWING REFERENCE NUMERALS

Figure 1:
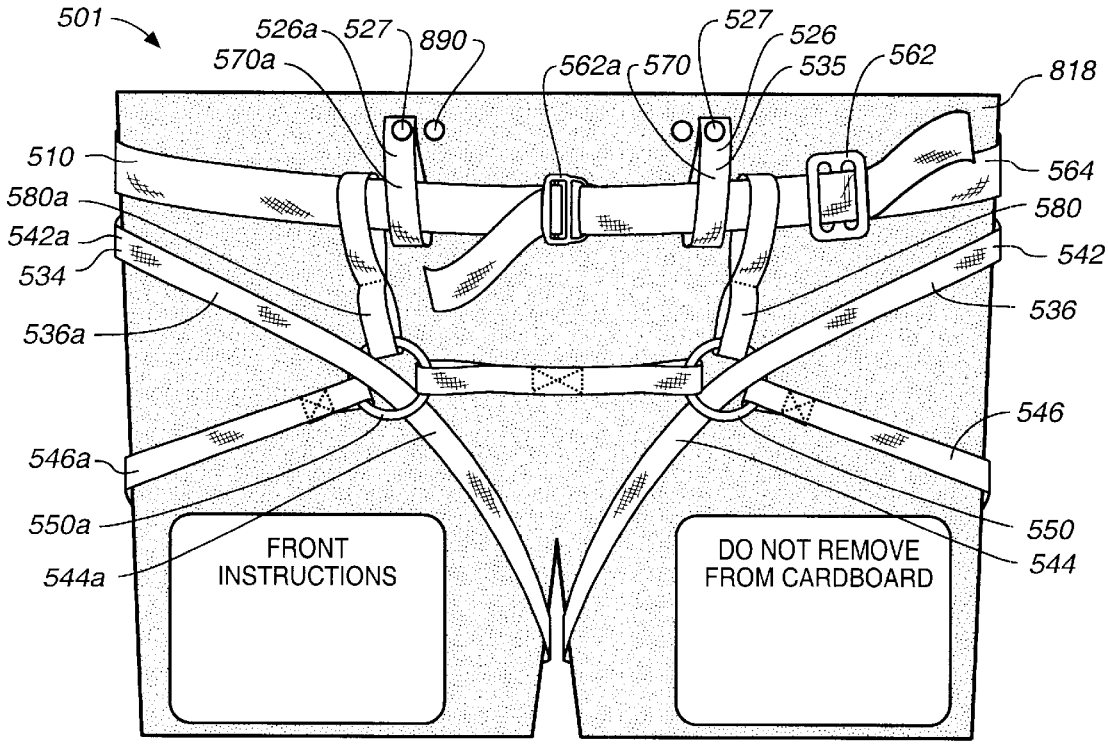
FIG. 1 is a front elevation of a first preferred embodiment of the harness apparatus of this invention, showing the harness strap assembly thereof in an open or first position on the installation assembly, FIG. 1A being a front elevation of the installation assembly.
Figure 3:
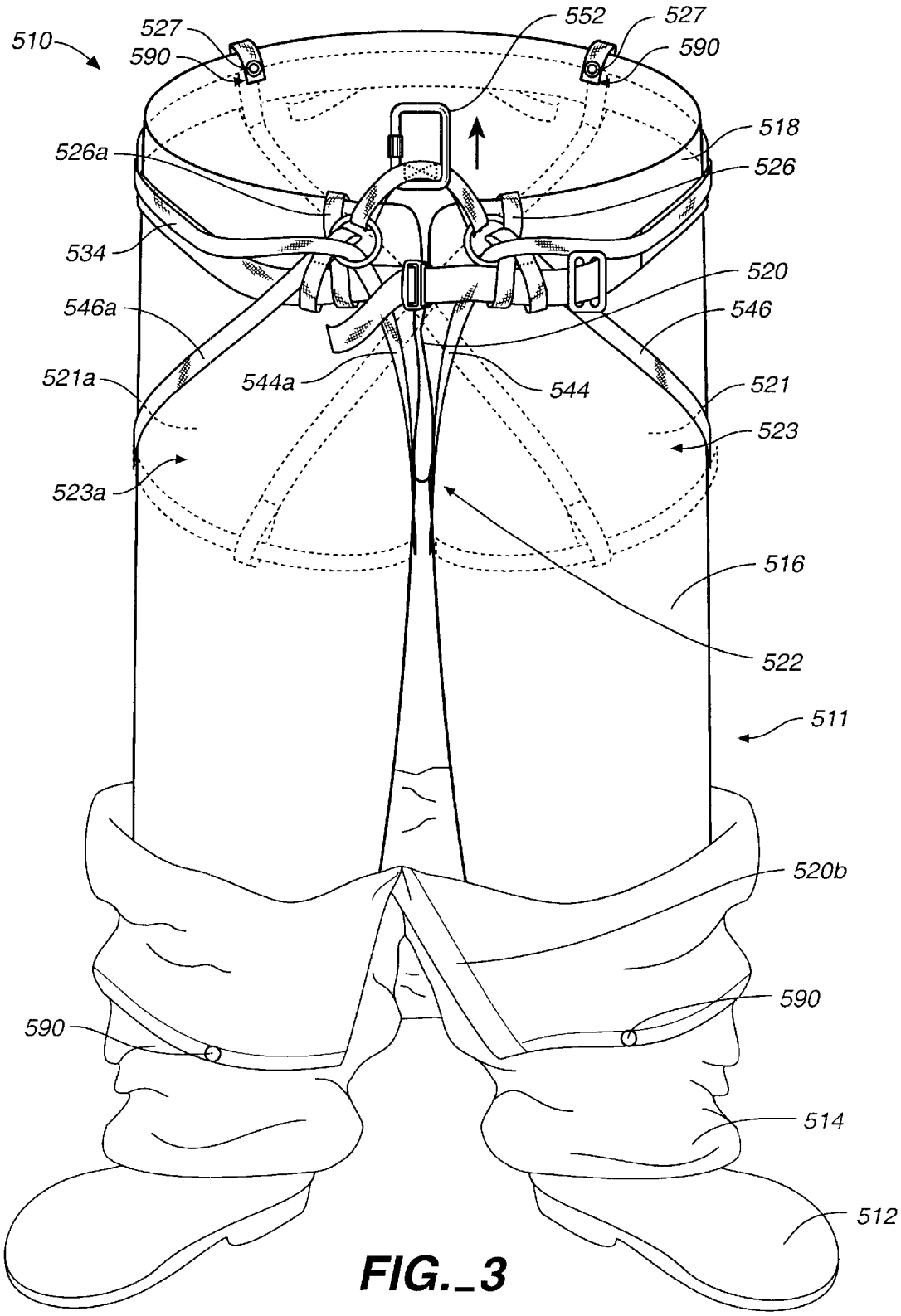
FIG. 3 is a front elevation of the embodiment of FIG. 1, showing the harness strap assembly in a closed or second position in the environment of a firefighter's turnout pants.

501 suspended extrication harness apparatus having installation assembly
510 suspended extrication harness apparatus
511 turnout pants
512 boots
514 shell
516 liner
518 waist
520 fly
520*b* fly
522 crotch
521 first buttock area
521*a* second buttock area
523 first pant thigh
523*a* second pant thigh
526 first front waist belt-loop strap
526*a* second front waist belt-loop strap
527 snap
530 first crotch belt-loop
530*a* second crotch belt-loop
534 harness strap assembly
535 suspender assembly
536 first strap member
536*a* second strap member
538 first free end
538*a* second free end
539 buckle strap
540 first adjustment buckle
540*a* second adjustment buckle
542 first waist portion
542*a* second waist portion
544 first crotch portion
544*a* second crotch portion
546 first thigh portion
546*a* second thigh portion
548 first looped end
548*a* second looped end
550 first carabiner ring
550*a* second carabiner ring
552 carabiner
562 first front buckle
562*a* second front buckle
564 waist belt
565 stitches
570 first front waist belt-loop
570*a* second front waist belt-loop
574 first rear waist belt-loop
574*a* second rear waist belt-loop
576 rear yoke
578 carabiner strap
580 first ring strap
580*a* second ring strap
583 post
584 socket
586 snap
588 post
590 snap
616 liner
627 suspender-type alligator clip
635 suspender assembly
716 liner
727 interlocking loop material
728 interlocking hook material
735 suspender assembly
786 interlocking loop material
816 installation assembly
818 waist
819 indicia
821 first buttock area
821*a* second buttock area
822 crotch
823 first thigh area
823*a* second thigh area
890 snap It is to be noted that, for convenience, the last two positions of the reference numerals of alternative embodiments of the invention duplicate those of the numerals of the embodiment of FIGS. 1 and 3, where reference is made to similar or corresponding parts. However, it should not be concluded merely from this numbering convention that similarly numbered parts are equivalents.

DETAILED DESCRIPTION OF THE INVENTION

Figure 1A:
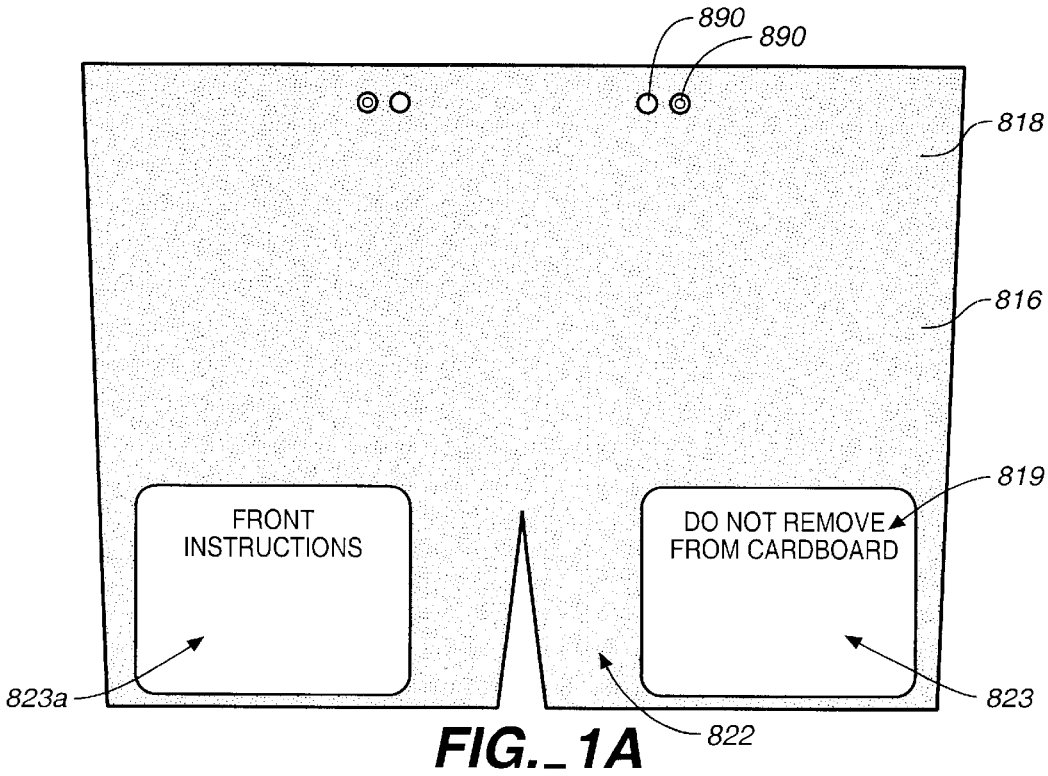
Figure 2:
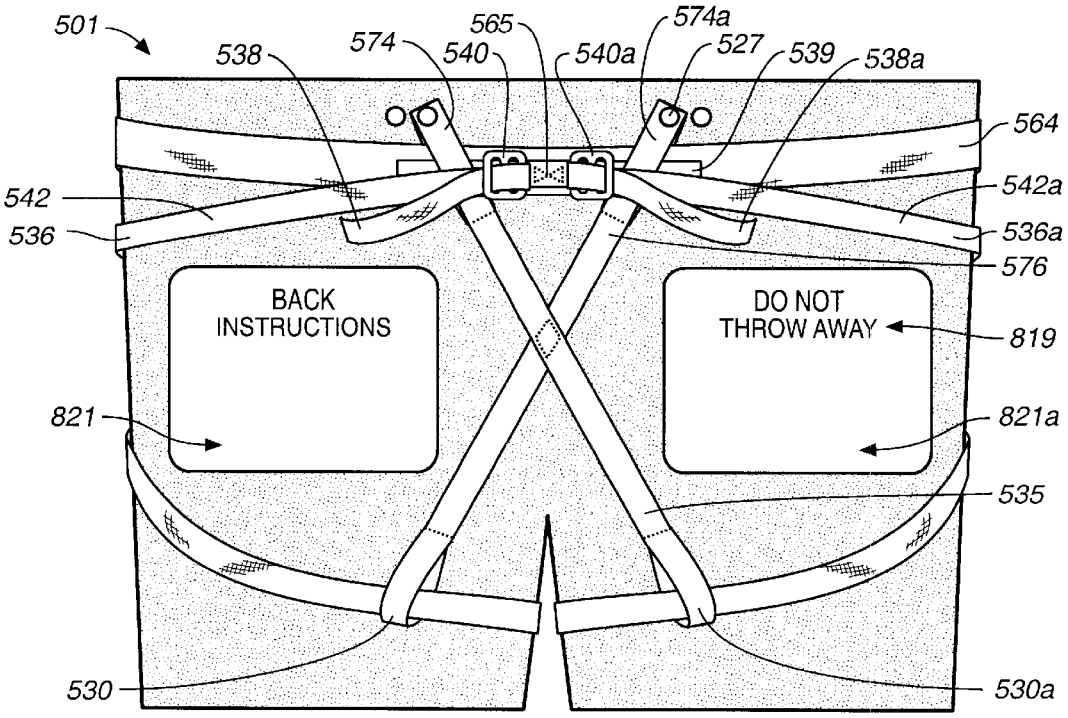
FIG. 2 is a rear elevation of the embodiment of FIG. 1 with the harness strap assembly in the first position, FIG. 2A being a rear elevation of the installation assembly.
Figure 2A:
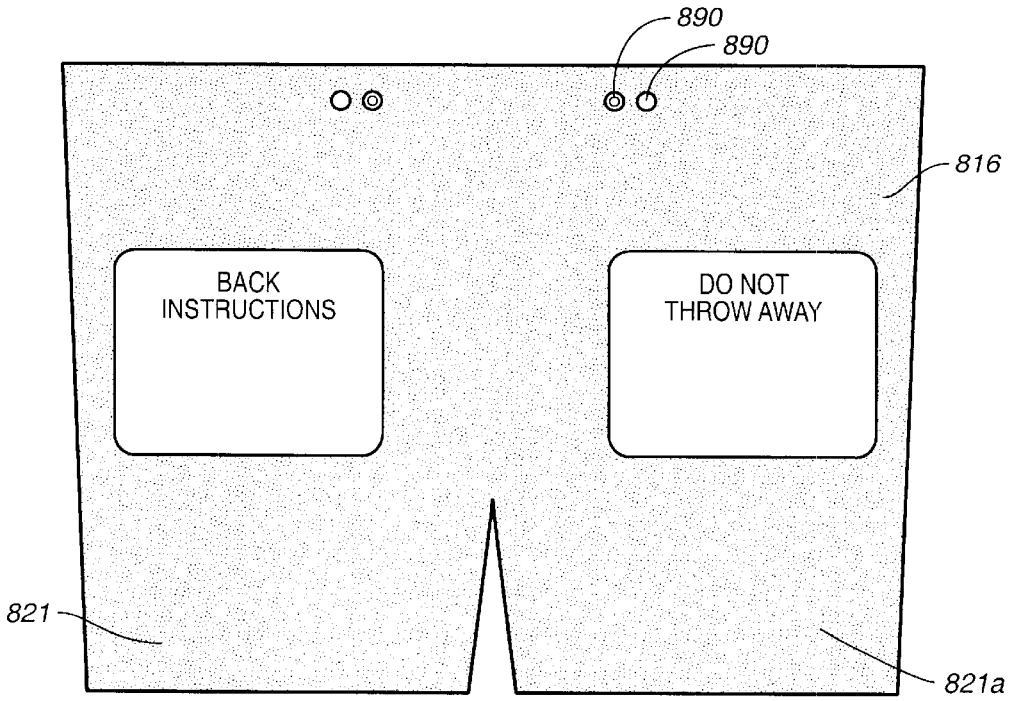

Referring generally to FIGS. 1 through 4, there is illustrated therein a suspended extrication harness apparatus 510 of this invention, normally installed during use in the environment of a firefighter's turnout pants 511 (FIG. 3). During shipment and sale, however, the suspended extrication harness apparatus 510 is mounted on a thin, rigid, planar installation assembly 816 (FIGS. 1A and 2A), made of cardboard, metal or plastic—thus forming a unitary suspended extrication harness apparatus having installation assembly 501. The free-moving harness strap assembly ("harness strap") 534 of the harness apparatus 510 is shown in FIG. 1 in a first (open or rest) position. FIG. 3 shows the harness strap 534 thereof in a second (closed or action) position. FIG. 2 is a rear elevation of the suspended extrication harness apparatus having installation assembly 501, including suspended extrication harness apparatus 510 and installation assembly 816, with the harness strap 534 in the first position. FIGS. 1A and 2A are front and rear elevations, respectively, of the planar installation assembly 816. It can be seen from a comparison of FIG. 1A and FIG. 3 that the installation assembly 816 has the two-dimensional frontal shape or profile of the upper portion of the turnout pants liner 516.

Figure 4:
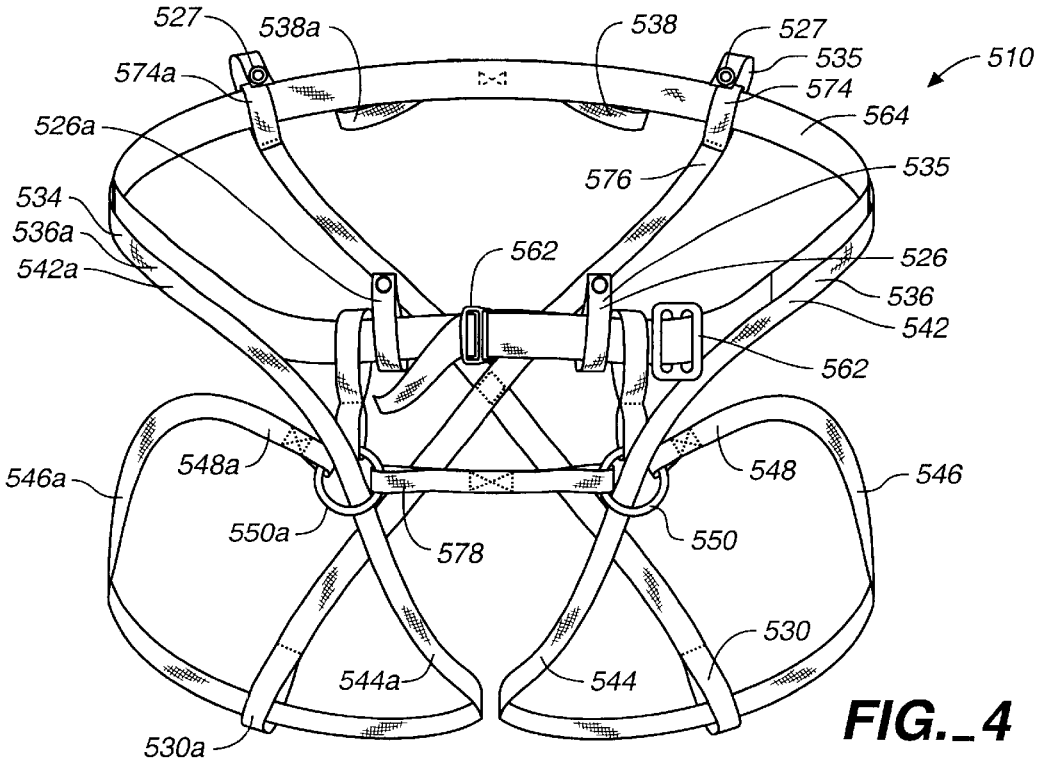
FIG. 4 is a front elevation of the embodiment of FIG. 1, showing just the suspended extrication harness apparatus.

FIG. 4 shows the suspended extrication harness apparatus 510 with both the installation assembly 816 and the turnout pants 511 removed. Insofar as the suspended extrication harness apparatus 510 normally should be engaged with one or the other, FIG. 4 is included for purposes of illustration only. The installation assembly 816 should be retained even after initial installation of the suspended extrication harness apparatus 510, because it can be used to retain the straps of the suspended extrication harness apparatus 510 in proper position when the harness is removed for cleaning or repair of the turnout pants 511.

The suspended extrication harness apparatus 510 is designed for installation in unmodified turnout pants 511, whose principal parts are a fireproof outer shell 514 and a thermal-barrier insulating fabric liner 516 encased in the shell. A waist belt 564 and two harness strap members 536, 536*a* of the harness strap assembly 534 are loosely and freely threaded though a series of belt-loops that are sewn, riveted or otherwise affixed to a suspender assembly 535. The suspender assembly 535, in turn, is suspended from the liner 516 using means compatible with the liner's factory-installed shell-attachment means, such as waist snaps 527 (see FIGS. 5–7, below), which means are standard equipment on such liners. Installation of the apparatus, therefore, does not require the perforation or other structural modification to the thermal barrier liner 516 that is done during the installation of prior art harnesses, which require, for example, stitching the belt-loops or harness strap in place on the liner or punching extra snaps or the like into the liner for that purpose. Furthermore, the loop-based suspension means of the present invention results in a harness strap assembly that is not fixedly attached or otherwise immobilized (by rivets, stitches, or the like) with respect to any structure at all—which is what is meant herein by the phrase "free-moving."

The pant liner 516 is bounded along its upper edge by its waist area 518, which waist is split in front, forming a liner fly 520 that is positioned during use directly behind the shell's fly 520*b*. Below the fly area is a crotch area 522, defined by the juncture of the fly, a first pant thigh area 523, and a second pant thigh area 523*a*. Behind the crotch 522, below the waist 518, the rear of the liner defines a pair of buttock areas 521, 521*a*. Of course, this trouser-like structure of the liner 516 is common in the art.

Figure 5:
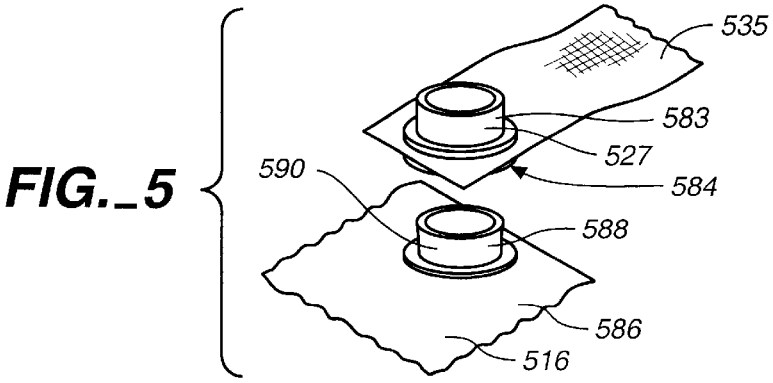
FIG. 5 is broken perspective detail view of a first preferred attachment means.

However, belt-loops typically are absent in prior art turnout suit pant liners, because normally the liners and shells are held together by hook and loop fasteners, snaps, or the like, and then the shells are held up by regular pants suspenders. The suspended extrication harness apparatus 510 of this invention has a regularly spaced series of belt-loops attached to a suspender assembly 535, which suspender assembly is removably attached to the liner 516, preferably through snaps 527, which snaps preferably incorporate both an attachment post 583 and an attachment socket 584 (FIG. 5). Because these suspender assembly belt-loops never bear any of the user's weight, the suspender 535 may be releasably secured by lightweight means, such as snaps, hook and loop fasteners, suspender-type alligator clips or the like.

The suspender assembly 535 preferably comprises three separate parts, although these parts might be combined into one or two pieces. Attached to the inner front of the waist 518 of the liner 516 by snaps 527 are a first front waist belt-loop strap 526 and a second front waist belt-loop strap 526*a*. The first front waist belt-loop strap 526 bears or is stitched to form a first front waist belt-loop 570 for supporting the waist belt 564. The second front waist belt-loop strap 526*a* bears or is stitched to form a second front waist belt-loop 570*a*. The third component of the suspender assembly 535 is a rear yoke 576, preferably shaped in the form of an "X" to properly position its belt-loops. However, other shapes for this yoke would be equivalent, such a the shape of an "H" (formed through the addition of a cross-strap). The upper ends of the rear yoke 576 bear or form a first rear waist belt-loop 574 and a second rear waist belt-loop 574*a*. The lower ends of the rear yoke 576 bear or form a first crotch belt-loop 530 and a second crotch belt-loop 530*a*. The "crotch" belt-loops are so named according to their approximate positions, which may range from the rear of crotch 522 to the lower edges of first buttock area 521 and second buttock area 521*a*. The rear yoke 576 is attached to snaps 590 on the inner rear of the waist 518 of the liner 516 by snaps 527. The first front waist belt-loop strap 526 and second front waist belt-loop strap 526*a* of the suspender assembly 535 similarly are attached by snaps 527 to snaps 590 on the inner front of the liner waist. In other embodiments, the suspender assembly 535 may be suspended by other attaching means, such as suspender-type alligator clips, stitches, hook and loop fasteners, or the like.

The suspender thus augments the waist 518 of the liner 516 with a plurality of, preferably at least four, waist belt-loops that are symmetrically spaced at regular intervals, namely, first front waist belt-loop 570, second front waist belt-loop 570*a*, first rear waist belt-loop 574 and second rear waist belt-loop 574*a*. On opposite sides of the rear of the crotch 522, by the first buttock area 521 and the second buttock area 521*a*, the rear yoke 576 positions first crotch belt-loop 530 and second crotch belt-loop 530*a*.

The harness strap assembly 534 preferably is made of two continuous pieces of strong, flexible webbed or woven cloth material. The two-part harness strap assembly 534 is comprised of a first strap member 536 and a second strap member 536*a*. These strap members 536, 536*a* are at all times securely held together at their un-looped free ends 538, 538*a* by harness strap length adjusting means, such as safety-tested, rescue-standard adjustment buckles 540, 540*a*, respectively (FIG. 2). Buckles 540, 540*a* are attached to a short buckle strap 539, which buckle strap 539 is attached to the waist belt 564 by stitches 565.

First waist portion 542 and second waist portion 542*a* of the harness strap assembly 534 are formed adjacent to and on either side of the adjustment buckles 540, 540*a*. The waist portions lead into a first crotch portion 544 and a second crotch portion 544*a*. The crotch portions of the harness strap 534 lead, in turn, to a first thigh portion 546 and a second thigh portion 546*a*. The latter portions terminate in a first looped end 548 and a second looped end 548*a*, respectively. Permanently sewn into the looped ends 548, 548*a* of the harness strap assembly 534 are a pair of circular metal (or strap) rings, namely, the first carabiner-holding ring 550 and the second carabiner-holding ring 550*a*. A carabiner strap 578 is attached by integral end loops between the carabiner-holding rings 550, 550*a*. Releasably affixed to the carabiner strap 578 is a standard metal carabiner 552 (FIG. 3) of conventional design. The carabiner strap 578 interlocks the carabiner-holding rings 550, 550*a*, and, through them, the looped ends 548, 548*a*—causing the free-moving harness strap assembly 534 itself to form a single loop overall that is intertwined with the newly supplied positioning belt-loops of the pant liner 516 in the manner described below.

The waist belt 564 is a strap that is separate from the two straps of the harness strap assembly 534 but which is attached thereto by means of the buckle strap 539. For comfort and support, the waist belt 564 may be wider than the various other straps. The free ends of the waist belt 564 may be fastened together by any suitable belt fastener means, such as first front buckle 562 and second front buckle 562*a* (or double D-rings, water knot, or the like). Preferably, first ring strap 580 and second ring strap 580*a* interconnect the waist belt 564 with the first carabiner-holding ring 550 and second-holding carabiner ring 550*a*, respectively. The waist belt may be worn loose and free-moving with respect to the liner 516 or it may be cinched up, as the user prefers. When cinched up, the waist belt 564 may be used to hold the turnout pants 511 up around the user's waist when pant suspenders become uncomfortable or are disconnected. The waist belt 564 may also be desired by some users to adjust the harness strap assembly 534 into a more comfortable position during normal firefighting operations (with the buckles 540 and 540*a* providing additional harness strap assembly adjustment means). The "inversion" or ring straps 580, 580*a* keep the carabiner strap 578 in a position wherein the carabiner 552 may quickly be located and drawn out through the shell's fly 520*b* in an emergency. They may also provide additional safety should the firefighter become inverted (head down) during a rappel—in such case, straps 580, 580*a* transfer force to the waist belt 564.

Beginning at the adjustment buckles 540, 540*a* at the rear of the suspended extrication harness apparatus 510, the waist portions 542, 542*a* of the harness strap 534 and the waist belt 564 (or just the waist belt, as seen in FIG. 2) are threaded through the first rear waist belt-loop 574 and second rear waist belt-loop 574*a*, respectively. Passing to the front of the apparatus 510, the first crotch portion 544 and second crotch portion 544*a* pass down through the first carabiner ring 550 and the second carabiner ring 550*a*, respectively. From these two rings, the crotch portions dip down and back through the crotch 522 where they pass through the first crotch belt-loop 530 and second crotch belt-loop 530*a*, respectively. Thereafter, the first thigh portion 546 and the second thigh portion 546*a* pass around under the user's (liner's) buttock areas 521, 521*a* (FIG. 3) and back up and forward in front of the first pant thigh 523 and the second pant thigh 523*a*, respectively. The first strap member 536 and second strap member 536*a* then terminate in the first carabiner-holding ring 550 and the second carabiner-holding ring 550*a*. Attached to or passing through the metal carabiner-holding rings (or ring-like strap loops) are the first crotch portion 544 and second crotch portion 544*a* of the first strap member 536 and second strap member 536*a*, respectively, the first and second ring straps 580, 580*a*, and the carabiner strap 578, as mentioned above.

The installation assembly 816 of the suspended extrication harness apparatus having installation assembly 501 is used to keep the suspended extrication harness apparatus 510 in proper configuration during shipment, storage and the like. Were it not for the installation assembly 816, the device would become entangled during shipment and storage, which would render it very difficult for the average user to install onto a turnout pants 511 in a safe and proper manner. FIGS. 1 and 2 illustrate this holding function of the installation assembly 816 of the suspended extrication harness apparatus having installation assembly 501. The installation assembly 816 is shaped to have many of the same parts as the liner 516 of a turnout pants 511. Thus, the front (FIG. 1A) of the installation assembly 816 has a "waist" 818, a first "thigh area" 823, a second "thigh area" 823*a*, and a notch forming a "crotch" 822. The rear (FIG. 2A) of the planar installation assembly 816 forms a first "buttock area" 821 a second "buttock area" 821*a*, and so on. Snaps 890 at the waist 818 have their posts facing both out the front of the installation assembly 816 and out the rear thereof, in positions corresponding to the waist snaps 590 of a liner 516. Indicia 819 may be imprinted on the front and back of the installation assembly 816 providing use and installation instructions, warnings, and like information for the user.

Accordingly, it can be seen from the drawing that the installation assembly 816 provides a support that may be used in place of a liner 516 during shipment and storage of the suspended extrication harness apparatus 510. When a firefighter wishes to install the suspended extrication harness apparatus 510 onto his or her liner 516, he or she merely needs to (without first removing the installation assembly 816) thread the legs of the liner 516 between the suspended extrication harness apparatus 510 and the installation assembly 816. In order to do this, either the front snaps 527 or the rear snaps 527 of the suspender assembly 535 first will have to be unsnapped—depending on whether the liner 516 is being threaded in front of or behind the installation assembly 816. Once all the straps of the suspended extrication harness apparatus 510 are in proper position with respect to the liner 516, the installation assembly 816 may be fully unsnapped and pulled out. Then, the snaps 527 (or similar attachment means) may be snapped onto the front and rear snaps 590 of the liner. Thereafter, the snaps 590 of the shell also may be snapped onto the snaps 527.

Figure 6:
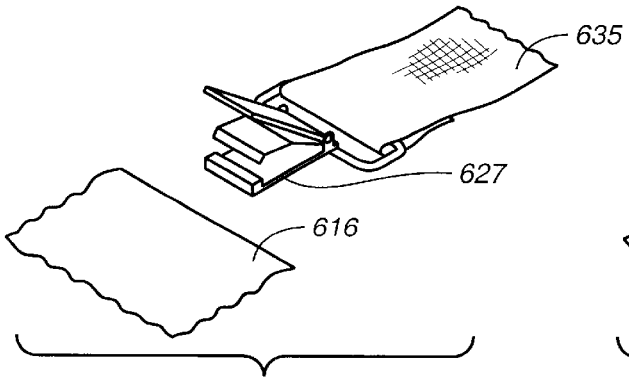
FIG. 6 is broken perspective detail view of a second preferred attachment means.
Figure 7:
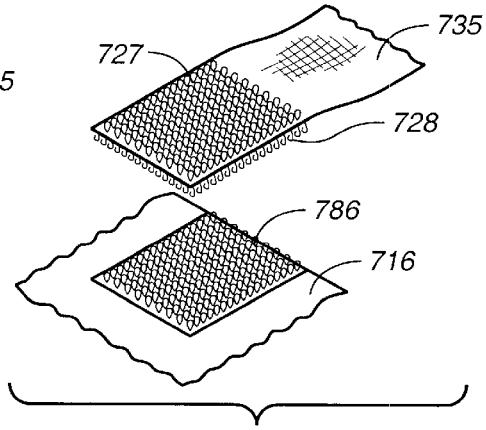
FIG. 7 is broken perspective detail view of a third preferred attachment means.

FIGS. 5–7 illustrate various preferred non-invasive means for attaching a suspender assembly to the liner of a firefighter's turnout pants (invasive means for attaching means for suspending the harness strap assembly include stitches or snaps that are added to the liner for that purpose and pierce it). Turnout pants themselves incorporate various alternative means for attaching the external shell to the liner. Normally, the liner comes with inwardly directed snaps 590 or the like around its waist area. The shell has similarly placed snaps 590 or the like and the shell is attached to the liner by curling it over the top of the liner and inside the waist area, whereupon the liner and shell may be snapped together.

FIG. 5 illustrates the preferred liner attachment means, as used in the embodiment of FIGS. 1–4. The liner 516 has on its inner waist surface a factory-installed snap 586 from which protrudes a post 588. The snaps 527 of the suspender assembly 535 preferably are of the dual function type. That is, each has a socket 584 into which may be inserted the post 588 of the liner snap 586 and each has on its obverse side a matching post 583 of its own. Accordingly, when the snaps 527 of the suspender assembly 535 are snapped onto the snaps 586 of the liner 516, replacement posts 583 are provided for snapping into the sockets of the snaps 590 (FIG. 3) of the shell 514.

FIG. 6 illustrates an embodiment of the invention adapted for use with a liner 616 having no built-in attachment means. Accordingly, the suspender assembly 635 thereof is provided with locking suspender-type alligator clips 627 in order that the suspender assembly may be hung from the liner without violating the integrity of the thermal barrier thereof.

In FIG. 7, the liner 716 has on its inner waist surface factory-installed interlocking loop material 786 (alternatively, interlocking loop material). Hook and loop fastener material on the suspender assembly 735 preferably performs a dual function similar to the embodiment of FIG. 1. That is, one side of the suspender bears patches of interlocking hook material 728 onto which may be grasped the interlocking loop material 786 of the liner 716 and, on the obverse side, bears matching patches of interlocking loop material 727. Accordingly, when the patches of interlocking hook material 728 of the suspender assembly 735 are pressed into engagement with the patches of interlocking loop material 786 of the liner 716, replacement patches of interlocking loop material 727 are provided for engaging hook material on the shell (not illustrated).

OPERATION

Use of the apparatus to extricate a firefighter or other safety worker from a hazardous emergency situation proceeds as follows.

After donning the apparatus 510 through use of the installation assembly 816, and after adjusting the effective length of the harness strap assembly 534 once by means of the adjustment buckles 540, 540*a* or other length adjusting means, the apparatus and liner are doffed and set aside. Typically, prior to use the suspended extrication harness apparatus 510 already will have the firefighter's boots 512 in place in the pant legs of the shell 514 and liner 516 so that all three may be donned simultaneously. Probably, the shell 514, suspended extrication harness apparatus 510, and liner 516 will be lifted up together (all three being snapped together), but for illustration in FIG. 3 the shell is down, showing the harness strap assembly 534 in the second action position, namely, with the carabiner 552 pulled up at the top of the fly, which position it will naturally assume during a rappel. With the shell 514 up and snapped in place, the harness strap 534 will fit so loosely in the first position (FIG. 1) as not to be noticed by the firefighter during normal operations.

Upon occurrence of an emergency, such as the rapid spread of fire on the floor in which he or she is working, the firefighter may simply take a rope (not illustrated) which has been brought along for such purposes, and tie one end thereof onto a stable fixed portion of the building, such as a pipe, beam or the like, according to rescue systems approved by the State Fire Marshal, OSHA, or the like. Next, the other end of said rope is threaded through the carabiner 552, and coiled thereon the standard number of times. The carabiner 552 may quickly be withdrawn for this purpose through the shell's fly 520*b* without need to lower the shell 514. The firefighter exits the building through a window (or off the roof), whereupon he or she may rappel in the standard manner down to the ground, or down to a non-burning floor in the case of a highrise building (i.e., one higher than three floors).

FIG. 3 shows the closed or second position that the free-moving harness strap assembly 534 automatically assumes when the carabiner 552 is jerked up by force of the climbing rope thereon. This action pulls the first thigh portion 546 and second thigh portion 546*a* inward and up, as well as the first crotch portion 544 and second crotch portion 544*a*. Such action significantly shortens the effective length of the harness strap assembly 534, tightening it securely and safely around the user's waist, buttocks and thighs, which parts of the body then support the firefighter's weight. No action is required on the user's part to accomplish this tightening, other than applying force to the part of the rope wound around the carabiner 552.

It is important to note that no part of the suspender assembly 535 is fixedly attached to the harness strap assembly. In other words, the harness strap is free to slide or otherwise move back and forth along its axial direction with respect to all parts of the suspender assembly 535, being affixed thereto only by means of loose-fitting loops. Accordingly, the harness strap 534 does not bind within the suspender assembly, and it also is free to slide and move with respect to all parts of the liner 516 without binding.

Therefore, the suspended extrication harness apparatus 510 is comfortable to wear, even unnoticeable, when not needed, but it automatically and immediately becomes safely and tightly secured in its proper place through free-moving self-adjustment when used.

As to other manners of usage and operation of the instant invention, the same should be apparent from the above disclosure, and accordingly no further discussion relative to the manner of usage and operation of the instant invention need be provided.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

For example, the number of waist belt-loops, crotch belt-loops, and the like can be increased or decreased, as desired for safety or comfort. Additionally, the width of such loops could be increased, perhaps to the extent that such loops become strap-encapsulating tube-like structures. Thigh belt-loops could be added at the bottom of the waist belt-loop straps 526, 526*a* for added support, as provided in application Ser. No. 09/616,099, the disclosure of which is incorporated by reference herein.

The three parts of the suspender assembly could be unified through further straps, webbing or the like. The carabiner-holding rings could be made of strap material rather than metal and the carabiner strap thereby eliminated.

Also, the preferred strap or belt material is nylon webbing (preferably flattened tubular). However, KEVLAR brand material, or a combination of natural and polymer materials could be substituted therefor.

Therefore, the above description and illustrations should not be construed as limiting the scope of the invention, which is defined by the appended claims.

The invention claimed is:

1. Extrication harness apparatus for a turnout pants liner of the type having a waist area, a crotch area, a pair of thigh areas, and a pair of buttock areas, including:

a harness strap assembly having a first harness strap member and a second harness strap member;

a waist belt, said first and second harness strap members attached to said waist belt;

a plurality of belt-loops attachable to said liner; and said waist belt and said first and second harness strap members threaded through said plurality of belt-loops so as, when said plurality of belt-loops are so attached to said liner, to pass said first and second harness strap members around said waist area, down through said crotch area, past said pair of buttock areas, around and up said pair of thigh areas, said harness strap assembly and waist belt thereby remaining free-moving with respect to all areas of said liner.

2. The apparatus of claim 1 further including:

a planar installation assembly onto which said harness strap assembly, waist belt and plurality of belt-loops are removably attached.

3. Extrication harness apparatus for a turnout pants liner of the type having a waist area, a crotch area, a pair of thigh areas, and a pair of buttock areas, including:

a harness strap assembly having a first harness strap member and a second harness strap member;

a waist belt, said first and second harness strap members adjustably attached to said waist belt;

a suspender assembly having a plurality of belt-loops;

means for attaching said suspender assembly to said liner; and said waist belt and said harness strap assembly threaded through said plurality of belt-loops so as, when said suspender assembly is attached to said liner by said attaching means, to pass said first and second harness strap members around said waist area, down through said crotch area, past said pair of buttock areas, around and up said pair of thigh areas, said harness strap assembly thereby remaining free-moving with respect to all areas of said suspender assembly.

4. The apparatus of claim 3 wherein:

said suspender assembly has
first and second front waist belt-loops;
first and second rear waist belt-loops; and
first and second crotch belt-loops.

5. The apparatus of claim 4 further including:

first and second ends of said first harness strap member;

third and fourth ends of said second harness strap member;

a carabiner;

a first carabiner-holding ring attached to said first end of said first harness strap member; and a second carabiner-holding ring attached to said third end of said second strap member, said carabiner attached to said harness strap assembly between said first and second carabiner-holding rings.

6. The apparatus of claim 5 wherein:

said carabiner is attached between said first and second carabiner-holding rings by being looped around a carabiner strap that is attached to said first and second carabiner-holding rings.

7. The apparatus of claim 6 wherein:

said waist belt is attached to said second and fourth ends of said first harness strap member and said second harness strap member, respectively.

8. The apparatus of claim 4 further including:

a rear yoke of said suspender assembly, said rear yoke having said first and second rear waist belt-loops and said first and second crotch belt-loops;

a first front waist belt-loop strap of said suspender assembly, said first front waist belt-loop strap having said first front waist belt-loop; and a second front waist belt-loop strap of said suspender assembly, said second front waist belt-loop strap having said second front waist belt-loop.

9. The apparatus of claim 8 wherein:

said rear yoke is X-shaped.

10. The apparatus of claim 3 further including:

an installation assembly onto which said harness strap assembly, waist belt and plurality of belt-loops are removably attached.

11. The apparatus of claim 10 wherein:

said installation assembly is planar and has the profile of an upper portion of said turnout pants liner.

12. The apparatus of claim 3 wherein:

said attaching means is a plurality of snaps.

13. The apparatus of claim 3 wherein:

said attaching means is a plurality of hook and loop fasteners.

14. The apparatus of claim 3 wherein:

said attaching means is a plurality of suspender-type alligator clips.

15. Extrication harness apparatus for a firefighter's turnout pants liner, including:

a harness strap assembly having a first harness strap member and a second harness strap member;

a waist belt, said first and second harness strap members adjustably attached to said waist belt;

a suspender assembly having
first and second front waist belt-loops;
first and second rear waist belt-loops; and
first and second crotch belt-loops;

a plurality of snaps on said suspender assembly; and said waist belt and said harness strap assembly threaded through said belt-loops and freely slideable therein and free-moving with respect to all areas of said suspender assembly.

16. The apparatus of claim 15 further including:

a planar installation assembly onto which said harness strap assembly, waist belt and belt-loops are removably attached, said installation assembly having the profile of an upper portion of said turnout pants liner.

17. The apparatus of claim 16 further including:

an X-shaped rear yoke of said suspender assembly, said rear yoke having said first and second rear waist belt-loops and said first and second crotch belt-loops;

a first front waist belt-loop strap of said suspender assembly, said first front waist belt-loop strap having said first front waist belt-loop; and a second front waist belt-loop strap of said suspender assembly, said second front waist belt-loop strap having said second front waist belt-loop.

18. The apparatus of claim 17 further including:

a buckle strap attached to said waist belt;

first and second adjustment buckles attached to said buckle strap; and said first harness strap member attached to said first adjustment buckle and said second harness strap member attached to said second adjustment buckle.

* * * * *